US006789624B2

(12) United States Patent
McGregor et al.

(10) Patent No.: US 6,789,624 B2
(45) **Date of Patent: *Sep. 14, 2004**

(54) APPARATUS AND METHOD FOR GRAVEL PACKING AN INTERVAL OF A WELLBORE

(75) Inventors: Ronald W. McGregor, Carrollton, TX (US); Robert Crow, Irving, TX (US); David A. Hejl, Dallas, TX (US); Ronald A. Gibson, Duncan, OK (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/160,216

(22) Filed: May 31, 2002

(65) Prior Publication Data

US 2003/0221828 A1 Dec. 4, 2003

(51) Int. Cl.[7] ..... E21B 43/04

(52) U.S. Cl. ..... 166/278; 166/51; 166/228

(58) Field of Search ..... 166/278, 51, 276, 166/227, 228

(56) References Cited

U.S. PATENT DOCUMENTS

| | | | | |
|---|---|---|---|---|
| 2,342,913 | A | 2/1944 | Williams et al. | |
| 2,344,909 | A | 3/1944 | Williams et al. | |
| 4,102,395 | A | 7/1978 | Robinson | |
| 4,932,474 | A | 6/1990 | Schroeder, Jr. et al. | |
| 4,945,991 | A | 8/1990 | Jones | 166/278 |
| 5,082,052 | A | 1/1992 | Jones et al. | 166/51 |
| 5,113,935 | A | 5/1992 | Jones et al. | 166/51 |
| 5,161,613 | A | 11/1992 | Jones | 166/242 |
| 5,161,618 | A | 11/1992 | Jones et al. | 166/308 |
| 5,165,476 | A | 11/1992 | Jones | |
| 5,333,688 | A | 8/1994 | Jones et al. | 166/278 |
| 5,333,689 | A | 8/1994 | Jones et al. | |
| 5,355,956 | A | 10/1994 | Restarick | 166/296 |
| 5,390,966 | A | 2/1995 | Cox et al. | 285/137.1 |
| 5,417,284 | A | 5/1995 | Jones | |
| 5,419,394 | A | 5/1995 | Jones | 166/51 |
| 5,435,391 | A | 7/1995 | Jones | |
| 5,443,117 | A | 8/1995 | Ross | 166/51 |
| 5,476,143 | A | 12/1995 | Sparlin et al. | 166/233 |
| 5,515,915 | A | 5/1996 | Jones et al. | 166/51 |
| 5,560,427 | A | 10/1996 | Jones | |

(List continued on next page.)

FOREIGN PATENT DOCUMENTS

| | | | |
|---|---|---|---|
| EP | 1 132 571 | 9/2001 | E21B/43/267 |
| WO | WO 99/12630 | 3/1999 | B01D/29/15 |
| WO | WO 00/61913 | 10/2000 | E21B/43/04 |

(List continued on next page.)

OTHER PUBLICATIONS

"Mechanical Fluid–Loss Control Systems Used During Sand Control Operations," H.L. Restarick of Otis Engineering Corp., 1992.

(List continued on next page.)

*Primary Examiner*—David Bagnell
*Assistant Examiner*—Daniel P Stephenson
(74) *Attorney, Agent, or Firm*—Lawrence R. Youst

(57) ABSTRACT

An apparatus and method for gravel packing an interval of a wellbore comprises an outer tubular (112), which forms a first annulus with the wellbore, and an sand control screen (118) disposed within the outer tubular (112) forming a second annulus therebetween. Within the second annulus is an axially extending production pathway (146) and an axially extending slurry passageway (144), which is defined between a sheet member (140) positioned on the sand control screen (118) and a channel (132). The outer tubular (112) has outlets (116) that are substantially aligned with outlets (142) of the channel (132). When a fluid slurry containing gravel is injected through the slurry passageway (144), the fluid slurry exits through the outlets (116, 142) leaving gravel in the first annulus, thereby gravel packing the interval.

28 Claims, 9 Drawing Sheets

U.S. PATENT DOCUMENTS

| | | | | |
|---|---|---|---|---|
| 5,588,487 | A | 12/1996 | Bryant | 166/51 |
| 5,636,691 | A | 6/1997 | Hendrickson et al. | 166/278 |
| 5,690,175 | A | 11/1997 | Jones | |
| 5,755,286 | A | 5/1998 | Ebinger | 166/281 |
| 5,842,516 | A | 12/1998 | Jones | 166/56 |
| 5,848,645 | A | 12/1998 | Jones | 166/280 |
| 5,868,200 | A | 2/1999 | Bryant et al. | 166/51 |
| 5,890,533 | A | 4/1999 | Jones | 166/51 |
| 5,921,318 | A | 7/1999 | Ross | 166/250.17 |
| 5,934,376 | A | 8/1999 | Nguyen et al. | 166/278 |
| 6,003,600 | A | 12/1999 | Nguyen et al. | 166/281 |
| 6,047,773 | A | 4/2000 | Zeltmann et al. | 166/281 |
| 6,059,032 | A | 5/2000 | Jones | 166/278 |
| 6,116,343 | A | 9/2000 | Van Petegem et al. | 166/297 |
| 6,125,933 | A | 10/2000 | Ross | 166/250.01 |
| 6,220,345 | B1 | 4/2001 | Jones et al. | 166/51 |
| 6,227,303 | B1 | 5/2001 | Jones | 166/378 |
| 6,230,803 | B1 | 5/2001 | Morton et al. | 166/278 |
| 6,343,651 | B1 | 2/2002 | Bixenman | 166/278 |
| 6,394,184 | B2 | 5/2002 | Tolman et al. | |
| 6,427,775 | B1 | 8/2002 | Dusterhoft et al. | |
| 6,446,722 | B2 | 9/2002 | Nguyen et al. | |
| 6,450,263 | B1 | 9/2002 | Schwendemann | |
| 6,464,007 | B1 | 10/2002 | Jones | |
| 6,481,494 | B1 | 11/2002 | Dusterhoft et al. | |
| 6,516,881 | B2 | 2/2003 | Hailey, Jr. | |
| 6,516,882 | B2 | 2/2003 | McGregor et al. | |
| 6,540,022 | B2 | 4/2003 | Dusterhoft et al. | |
| 6,543,538 | B2 | 4/2003 | Tolman et al. | |
| 6,557,634 | B2 | 5/2003 | Hailey, Jr. et al. | |
| 6,557,635 | B2 | 5/2003 | Nguyen et al. | |
| 6,571,872 | B2 | 6/2003 | Dusterhoft et al. | |
| 6,581,689 | B2 | 6/2003 | Hailey, Jr. | |
| 6,588,506 | B2 | 7/2003 | Jones | |
| 6,588,507 | B2 | 7/2003 | Dusterhoft et al. | |
| 6,601,646 | B2 | 8/2003 | Streich et al. | |
| 6,644,406 | B1 | 11/2003 | Jones | |
| 6,702,018 | B2 | 3/2004 | McGregor et al. | |
| 6,702,019 | B2 | 3/2004 | Dusterhoft et al. | |
| 2003/0183386 | A1 | 10/2003 | McGregor et al. | |

FOREIGN PATENT DOCUMENTS

| | | | |
|---|---|---|---|
| WO | WO 01/14691 | 3/2001 | E21B/43/08 |
| WO | WO 01/44619 | 6/2001 | E21B/43/04 |
| WO | WO 02/10554 | 2/2002 | E21B/43/26 |

OTHER PUBLICATIONS

"Sand Control Screens," Halliburton Energy Services, 1994.

"Frac Pack Technology Still Evolving," Charles D. Ebinger of Ely & Associates Inc.; Oil & Gas Journal, Oct. 23, 1995.

"Screenless Single Trip Multizone Sand Control Tool System Saves Rig Time," Travis Hailey and Morris Cox of Haliburton Energy Services, Inc.; and Kirk Johnson of BP Exploration (Alaska), Inc. Society of Petroleum Engineers Inc., Feb., 2000.

"Caps$^{SM}$ Sand Control Service for Horizontal Completions Improves Gravel Pack Reliability and Increases Production Potential from Horizontal Completions," Halliburton Energy Services, Inc., Aug., 2000.

"CAPS$^{SM}$ Concentric Annular Packing Service for Sand Control," Halliburton Energy Services, Inc., Aug., 2000.

"Simultaneous Gravel Packing and Filter Cake Removal in Horizontal Wells Applying Shunt Tubes and Novel Carrier and Breaker Fluid," Pedro M. Saldungaray of Schlumberger; Juan C. Troncoso of Repson–YPF; Bambang T. Santoso of Repsol–YPF. Society of Petroleum Engineers, Inc., Mar., 2001.

"The Only Way to Seal it Shut is to Pneuma–Seal it," DESIGNFAX, Jan. 2002.

APPARATUS AND METHOD FOR GRAVEL PACKING AN INTERVAL OF A WELLBORE

TECHNICAL FIELD OF THE INVENTION

This invention relates in general to preventing the production of particulate materials through a wellbore traversing an unconsolidated or loosely consolidated subterranean formation and, in particular to, an apparatus and method for obtaining a substantially complete gravel pack within an interval of the wellbore.

BACKGROUND OF THE INVENTION

Without limiting the scope of the present invention, its background is described with reference to the production of hydrocarbons through a wellbore traversing an unconsolidated or loosely consolidated formation, as an example.

It is well known in the subterranean well drilling and completion art that particulate materials such as sand may be produced during the production of hydrocarbons from a well traversing an unconsolidated or loosely consolidated subterranean formation. Numerous problems may occur as a result of the production of such particulate. For example, the particulate causes abrasive wear to components within the well, such as tubing, pumps and valves. In addition, the particulate may partially or fully clog the well creating the need for an expensive workover. Also, if the particulate matter is produced to the surface, it must be removed from the hydrocarbon fluids by processing equipment at the surface.

One method for preventing the production of such particulate material to the surface is gravel packing the well adjacent the unconsolidated or loosely consolidated production interval. In a typical gravel pack completion, a sand control screen is lowered into the wellbore on a work string to a position proximate the desired production interval. A fluid slurry including a liquid carrier and a particulate material known as gravel is then pumped down the work string and into the well annulus formed between the sand control screen and the perforated well casing or open hole production zone.

The liquid carrier either flows into the formation or returns to the surface by flowing through the sand control screen or both. In either case, the gravel is deposited around the sand control screen to form a gravel pack, which is highly permeable to the flow of hydrocarbon fluids but blocks the flow of the particulate carried in the hydrocarbon fluids. As such, gravel packs can successfully prevent the problems associated with the production of particulate materials from the formation.

It has been found, however, that a complete gravel pack of the desired production interval is difficult to achieve particularly in long or inclined/horizontal production intervals. These incomplete packs are commonly a result of the liquid carrier entering a permeable portion of the production interval causing the gravel to form a sand bridge in the annulus. Thereafter, the sand bridge prevents the slurry from flowing to the remainder of the annulus which, in turn, prevents the placement of sufficient gravel in the remainder of the annulus.

Prior art devices and methods have been developed which attempt to overcome this sand bridge problem. For example, attempts have been made to use devices having perforated shunt tubes or bypass conduits that extend along the length of the sand control screen to provide an alternate path for the fluid slurry around the sand bridge. It has been found, however, that shunt tubes installed on the exterior of sand control screens are susceptible to damage during installation and may fail during a gravel pack operation. In addition, it has been found that it is difficult and time consuming to make all of the necessary fluid connections between the numerous joints of shunt tubes required for typical production intervals.

Therefore a need has arisen for an apparatus and method for gravel packing a production interval traversed by a wellbore that overcomes the problems created by sand bridges. A need has also arisen for such an apparatus that is not susceptible to damage during installation or failure during use. Further, a need has arisen for such an apparatus that is not difficult or time consuming to assemble.

SUMMARY OF THE INVENTION

The present invention disclosed herein comprises an apparatus and method for gravel packing a production interval of a wellbore that traverses an unconsolidated or loosely consolidated formation that overcomes the problems created by the development of a sand bridge between a sand control screen and the wellbore. Importantly, the apparatus of the present invention is not susceptible to damage during installation or failure during use and is not difficult or time consuming to assemble.

The apparatus for gravel packing an interval of a wellbore of the present invention comprises an outer tubular forming a first annulus with the wellbore and a sand control screen disposed within the outer tubular forming a second annulus therebetween. Together, the sand control screen and the outer tubular of the present invention are assembled at the surface and run downhole to a location proximate the production interval. The outer tubular includes a plurality of openings that allow for the production of fluids therethrough and plurality of outlets that allow the distribution of a fluid slurry containing gravel therethrough.

In the volume within the second annulus between the sand control screen and the outer tubular there are one or more channels that define axially extending slurry passageways with sheet members positioned between the channels and the sand control screen. The sheet members create a barrier to the flow of fluids between the channels and the sand control screen. The volume within the second annulus between adjacent channels forms axially extending production pathways. The channels prevent fluid communication between the production pathways and the slurry passageways. In addition, isolation members at either end of a section of the apparatus of the present invention define the axial boundaries of the production pathways.

As such, when a fluid slurry containing gravel is injected through the slurry passageways, the fluid slurry exits the slurry passageways through outlets in the channels and the outer tubular leaving a first portion of the gravel in the first annulus. Thereafter, the fluid slurry enters the openings in the outer tubular leaving a second portion of the gravel in the production pathways. Thus, when formation fluids are produced, the formation fluids travel radially through the production pathways by entering the openings in the outer tubular and exiting the production pathways through the sand control screen. The formation fluids pass through the first portion of the gravel in the first annulus prior to entry into the production pathways, which contains the second portion of the gravel, both of which filter out the particulate materials in the formation fluids. Formation fluids are prevented, however, from traveling radially through the slurry passageways as the sheet members prevent such flow.

In a typical gravel packing operation using the apparatus for gravel packing an interval of a wellbore of the present invention, the first annulus between the outer tubular and the wellbore may serve as a primary path for delivery of a fluid slurry. This region serves as the primary path as it provides the path of least resistance to the flow of the fluid slurry. When the primary path becomes blocked by sand bridge formation, the production pathways of the present invention serves as a secondary path for delivery of the fluid slurry. The production pathways serve as the secondary path as they provides the path of second least resistance to the flow of the fluid slurry. When the primary and secondary paths become blocked by sand bridge formation, the slurry passageways serve as a tertiary path for delivery of the fluid slurry. The slurry passageways serve as the tertiary path as they provide the path of greatest resistance to the flow of the fluid slurry but are least likely to have sand bridge formation therein due to the high velocity of the fluid slurry flowing therethrough and their substantial isolation from the formation.

Commonly, more than one section of the apparatus for gravel packing an interval of a wellbore must be coupled together to achieve a length sufficient to gravel pack an entire production interval. In such cases, multiple sections of the apparatus of the present invention are coupled together, for example, via a threaded connection. Also, in such cases, the slurry passageways of the various sections are in fluid communication with one another allowing an injected fluid slurry to flow from one such apparatus to the next, while the production pathways of the various sections are in fluid isolation from one another.

In a method for gravel packing an interval of a wellbore of the present invention, the method comprises providing a wellbore that traverses a formation, either open hole or cased, perforating the casing, in the cased hole embodiment, proximate the formation to form a plurality of perforations, locating a gravel packing apparatus including a sand control screen within the wellbore proximate the formation to form a first annulus between the gravel packing apparatus and the wellbore and a second annulus between the sand control screen and the outer tubular, injecting a fluid slurry containing gravel through slurry passageways formed between sheet members and channels with the second annulus such that the fluid slurry exits through the outlets of the channels and the outer tubular into the first annulus, depositing a first portion of the gravel in the first annulus, depositing a second portion of the gravel in the production pathways by returning a portion of the fluid slurry through openings in the outer tubular and terminating the injection when the first annulus and the production pathways are substantially completely packed with gravel.

In addition to injecting the fluid slurry containing gravel through the slurry passageways, in some embodiments, the fluid slurry may also be injected down the first annulus. In this case, the method also involves injecting a fluid slurry containing gravel into a primary path defined by the first annulus, diverting the fluid slurry containing gravel into a secondary path defined by the production pathways if the primary path becomes blocked, diverting the fluid slurry containing gravel into a tertiary path defined by the slurry passageways if the primary and secondary paths become blocked and terminating the injecting when the interval is substantially completely packed with the gravel.

BRIEF DESCRIPTION OF THE DRAWINGS

For a more complete understanding of the features and advantages of the present invention, reference is now made to the detailed description of the invention along with the accompanying figures in which corresponding numerals in the different figures refer to corresponding parts and in which.

DETAILED DESCRIPTION OF THE INVENTION

While the making and using of various embodiments of the present invention are discussed in detail below, it should be appreciated that the present invention provides many applicable inventive concepts which can be embodied in a wide variety of specific contexts. The specific embodiments discussed herein are merely illustrative of specific ways to make and use the invention, and do not delimit the scope of the present invention.

Figure 1:
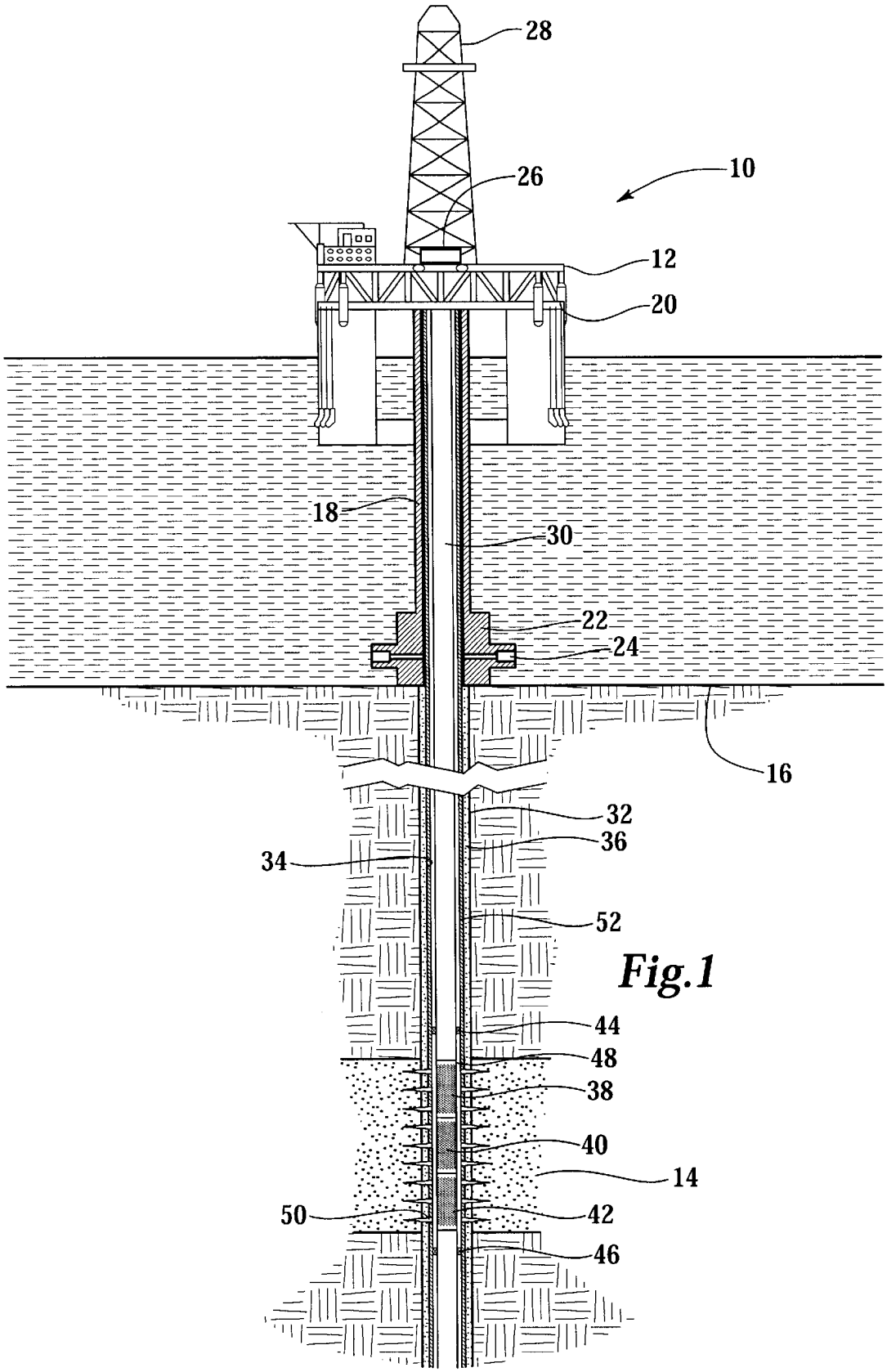
FIG. 1 is a schematic illustration of an offshore oil and gas platform operating an apparatus for gravel packing an interval of a wellbore of the present invention.

Referring initially to FIG. 1, several apparatuses for gravel packing an interval of a wellbore operating from an offshore oil and gas platform are schematically illustrated and generally designated 10. A semi-submersible platform 12 is centered over a submerged oil and gas formation 14 located below sea floor 16. A subsea conduit 18 extends from deck 20 of platform 12 to wellhead installation 22 including blowout preventers 24. Platform 12 has a hoisting apparatus 26 and a derrick 28 for raising and lowering pipe strings such as work string 30.

A wellbore 32 extends through the various earth strata including formation 14. A casing 34 is cemented within wellbore 32 by cement 36. Work string 30 includes various tools including apparatuses 38, 40, 42 for gravel packing an interval of wellbore 32 adjacent to formation 14 between packers 44, 46 and into annular region 48. When it is desired to gravel pack annular region 48, work string 30 is lowered through casing 34 until apparatuses 38, 40, 42 are positioned adjacent to formation 14 including perforations 50. Thereafter, a fluid slurry including a liquid carrier and a particulate material such as sand, gravel or proppants is pumped down work string 30.

As explained in more detail below, the fluid slurry may be injected entirely into apparatus 38 and sequentially flow through apparatuses 40, 42. During this process, portions of the fluid slurry exit each apparatus 38, 40, 42 such that the fluid slurry enters annular region 48. Once in annular region 48, a portion of the gravel in the fluid slurry is deposited therein. Some of the liquid carrier may enter formation 14 through perforation 50 while the remainder of the fluid carrier, along with some of the gravel, reenters certain sections of apparatuses 38, 40, 42 depositing gravel in those sections. As a sand control screen (not pictured) is positioned within apparatuses 38, 40, 42, the gravel remaining in the fluid slurry is disallowed from further migration. The liquid carrier, however, can travel through the sand control screen, into work string 30 and up to the surface in a known manner, such as through a wash pipe and into the annulus 52 above packer 44. The fluid slurry is pumped down work string 30 through apparatuses 38, 40, 42 until annular section 48 surrounding apparatuses 38, 40, 42 and portions of apparatuses 38, 40, 42 are filled with gravel.

Alternatively, instead of injecting the entire stream of fluid slurry into apparatuses 38, 40, 42, all or a portion of the fluid slurry could be injected directly into annular region 48 in a known manner such as through a crossover tool (not pictured) which allows the slurry to travel from the interior of work string 30 to the exterior of work string 30. Again, once this portion of the fluid slurry is in annular region 48, a portion of the gravel in the fluid slurry is deposited in annular region 48. Some of the liquid carrier may enter formation 14 through perforation 50 while the remainder of the fluid carrier along with some of the gravel enters certain sections of apparatuses 38, 40, 42 filling those sections with gravel. The sand control screen (not pictured) within apparatuses 38, 40, 42 disallows further migration of the gravel but allows the liquid carrier to travel therethrough into work string 30 and up to the surface. If the fluid slurry is injected directly into annular region 48 and a sand bridge forms, the fluid slurry is diverted into apparatuses 38, 40, 42 to bypass this sand bridge such that a complete pack can nonetheless be achieved. The fluid slurry entering apparatuses 38, 40, 42 may enter apparatuses 38, 40, 42 proximate work string 30 or may enter apparatuses 38, 40, 42 from annular region 48 via one or more inlets on the exterior of one or more of the apparatuses 38, 40, 42. These inlets may include pressure actuated devices, such as valves, rupture disks and the like disposed therein to regulate the flow of the fluid slurry therethrough.

Even though FIG. 1 depicts a vertical well, it should be noted by one skilled in the art that the apparatus for gravel packing an interval of a wellbore of the present invention is equally well-suited for use in deviated wells, inclined wells or horizontal wells. Also, even though FIG. 1 depicts an offshore operation, it should be noted by one skilled in the art that the apparatus for gravel packing an interval of a wellbore of the present invention is equally well-suited for use in onshore operations.

Figure 2:
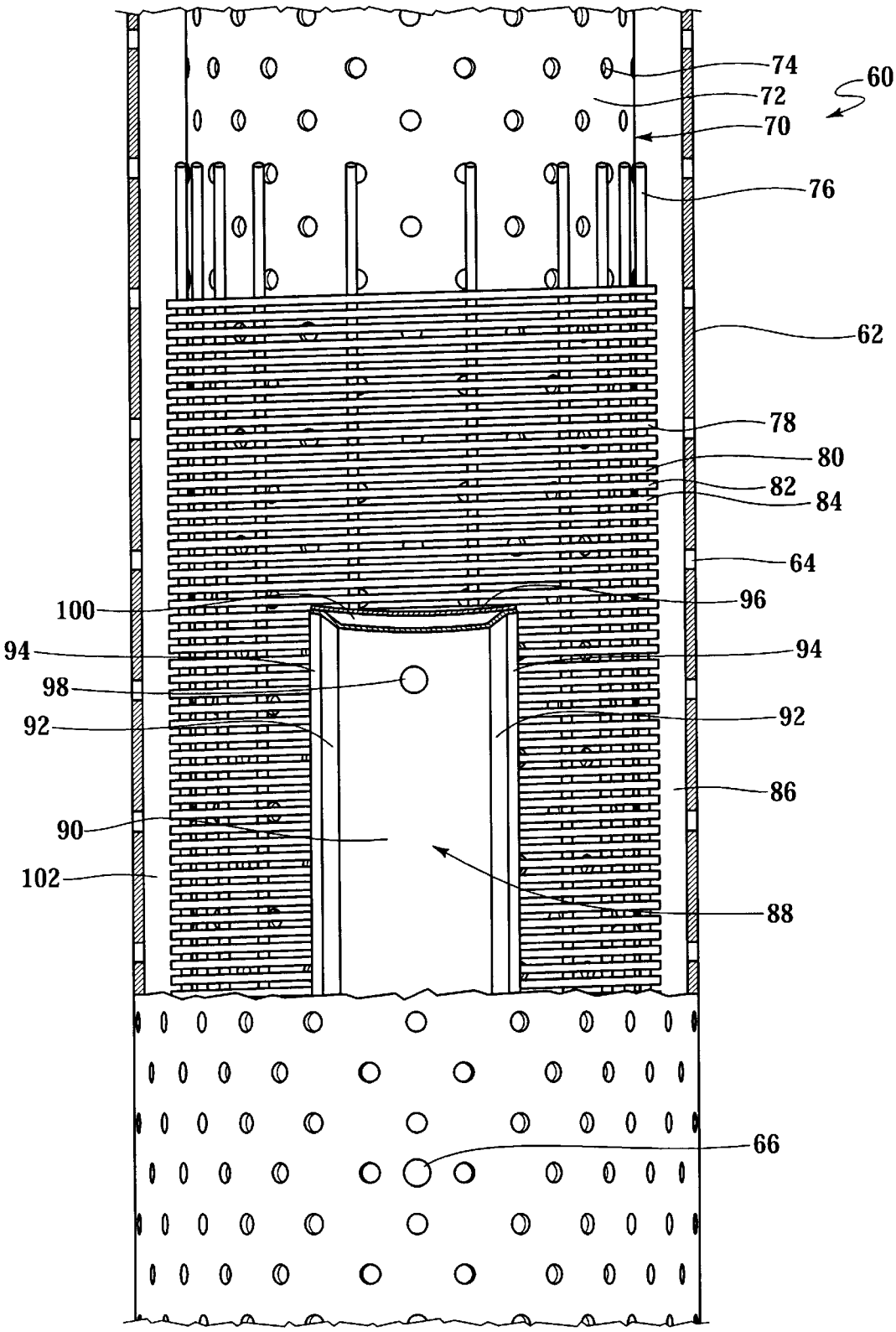
FIG. 2 is partial cut away view of an apparatus for gravel packing an interval of a wellbore of the present invention in position around a sand control screen.

Referring now to FIG. 2, therein is depicted a partial cut away view of an apparatus for gravel packing an interval of a wellbore of the present invention that is generally designated 60. Apparatus 60 has an outer tubular 62 that includes a plurality of openings 64 that are substantially evenly distributed around and along the length of outer tubular 62. In addition, outer tubular 62 includes a plurality outlets 66. For reasons that will become apparent to those skilled in the art, the density of opening 64 of outer tubular 62 is much greater than the density of outlets 66 of outer tubular 62. Also, it should be noted by those skilled in the art that even though FIG. 2 has depicted openings 64 and outlets 66 as being circular, other shaped openings may alternatively be used without departing from the principles of the present invention. Likewise, even though FIG. 2 has depicted openings 64 as being smaller than outlets 66, openings 64 could alternatively be larger than or the same size as outlets 66 without departing from the principles of the present invention. In addition, the exact number, size and shape of openings 64 are not critical to the present invention, so long as sufficient area is provided for fluid production therethrough and the integrity of outer tubular 62 is maintained.

Disposed within outer tubular 62 is a sand control screen 70. Sand control screen 70 includes a base pipe 72 that has a plurality of openings 74 which allow the flow of production fluids into the production tubing. The exact number, size and shape of openings 74 are not critical to the present invention, so long as sufficient area is provided for fluid production and the integrity of base pipe 72 is maintained.

Spaced around base pipe 72 is a plurality of ribs 76. Ribs 76 are generally symmetrically distributed about the axis of base pipe 72. Ribs 76 are depicted as having a cylindrical cross section, however, it should be understood by one skilled in the art that ribs 76 may alternatively have a rectangular or triangular cross section or other suitable geometry. Additionally, it should be understood by one skilled in the art that the exact number of ribs 76 will be dependent upon the diameter of base pipe 72 as well as other design characteristics that are well known in the art.

Wrapped around ribs 76 is a screen wire 78. Screen wire 78 forms a plurality of turns, such as turn 80, turn 82 and turn 84. Between each of the turns is a gap through which formation fluids flow. The number of turns and the gap between the turns are determined based upon the characteristics of the formation from which fluid is being produced and the size of the gravel to be used during the gravel packing operation. Together, ribs 76 and screen wire 78 may form a sand control screen jacket which is attached to base pipe 72 by welding or other suitable techniques.

Disposed within an annulus 86 on opposite sides of one another and between outer tubular 62 and sand control screen 70 is a pair of channels 88, only one being visible. Channels 88 include a web 90 and a pair of oppositely disposed sides 92 each having an end 94. Ends 94 are attached to a sheet member 96 and, in turn, to sand control screen 70 by, for example, welding or other suitable techniques. Channels 88 includes a plurality of outlets 98 that are substantially aligned with outlets 66 of outer tubular 62. Together, channels 88 and sheet members 96 define slurry passageways 100. Between channels 88 are production pathways 102 which are defined by the radial boundaries of outer tubular 62 and sand control screen 70 and the circumferential boundaries of sides 92 of channels 88. Slurry passageways 100 and production pathways 102 are in fluid isolation from one another.

It should be understood by those skilled in the art that while FIG. 2 has depicted a wire wrapped sand control screen, other types of filter media could alternatively be used in conjunction with the apparatus of the present invention, including, but not limited to, a fluid-porous, particulate restricting, sintered metal material such as a plurality of layers of a wire mesh that are sintered together to form a porous sintered wire mesh screen designed to allow fluid flow therethrough but prevent the flow of particulate materials of a predetermined size from passing therethrough.

Figure 3:
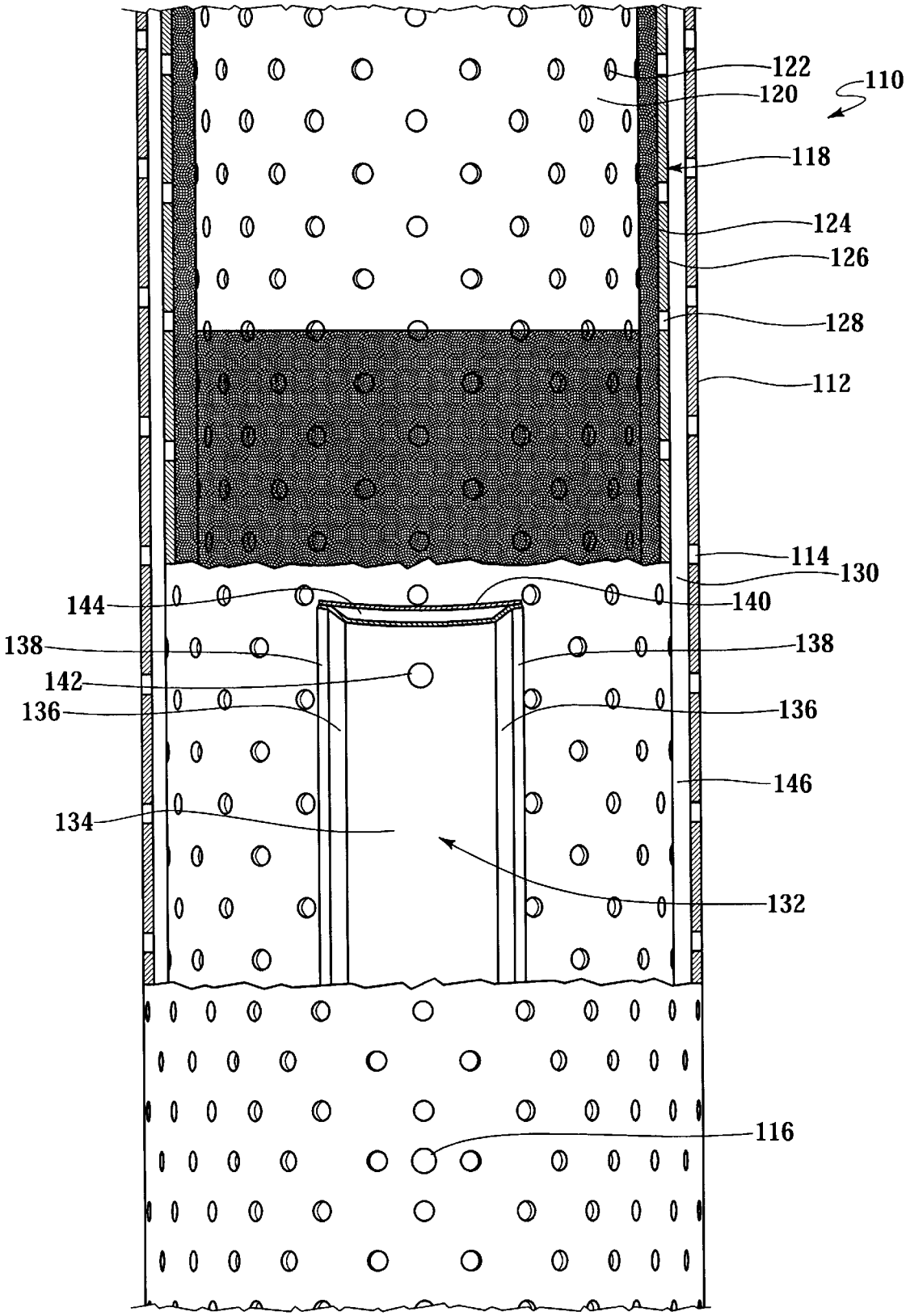
FIG. 3 is partial cut away view of an apparatus for gravel packing an interval of a wellbore of the present invention in position around a sand control screen.

More specifically and referring now to FIG. 3, therein is depicted a partial cut away view of an apparatus for gravel packing an interval of a wellbore of the present invention that is generally designated 110. Apparatus 110 has an outer tubular 112 that includes a plurality of openings 114 that are substantially evenly distributed around and along the length of outer tubular 112, which allow the flow of production fluids therethrough. In addition, outer tubular 112 includes a plurality of outlets 116.

Disposed within outer tubular 112 is a sand control screen assembly 118. Sand control screen assembly 118 includes a base pipe 120 that has a plurality of openings 122 which allow the flow of production fluids into the production tubing. The exact number, size and shape of openings 122 are not critical to the present invention, so long as sufficient area is provided for fluid production and the integrity of base pipe 120 is maintained.

Positioned around base pipe 120 is a fluid-porous, particulate restricting, sintered metal material such as plurality of layers of a wire mesh that are sintered together to form a porous sintered wire mesh screen 124. Screen 124 is designed to allow fluid flow therethrough but prevent the flow of particulate materials of a predetermined size from passing therethrough. The layers of wire mesh may include drain layers that have a mesh size that is larger than the mesh size of the filter layers. For example, a drain layer may preferably be positioned as the outermost layer and the innermost layer of wire mesh screen 124 with the filter layer or layers positioned therebetween. Positioned around screen 124 is a screen wrapper 126 that has a plurality of openings 128 which allow the flow of production fluids therethrough. The exact number, size and shape of openings 128 is not critical to the present invention, so long as sufficient area is provided for fluid production and the integrity of screen wrapper 126 is maintained. Typically, various sections of screen 124 and screen wrapper 126 are manufactured together as a unit by, for example, sintering a number layers of wire mesh that form screen 124 together with screen wrapper 126, then rolling the unit into a tubular configuration. The two ends of the tubular unit are then seam welded together. Several tubular units of the screen and screen wrapper combination are placed over each joint of base pipe 120 and secured thereto by welding or other suitable technique, as will be explained in greater detail below.

Disposed in annulus 130 between outer tubular 112 and sand control screen 118 and on opposite sides of each other is a pair of channels 132, only one channel 132 being visible. Channels 132 include a web 134 and a pair of oppositely disposed sides 136 each having an end 138. Ends 138 are attached to a sheet member 140 and, in turn, to screen wrapper 126 by welding or other suitable technique. Channels 132 include a plurality of outlets 142 that are substantially aligned with outlets 116 of outer tubular 112 and are preferably formed at the same time by drilling or other suitable technique once gravel packing apparatus 110 is assembled. Together, channels 132 and sheet members 140 form slurry passageways 144. Also, channels 132 define the circumferential boundary between a slurry passageway 144 and production pathways 146.

Figure 4:
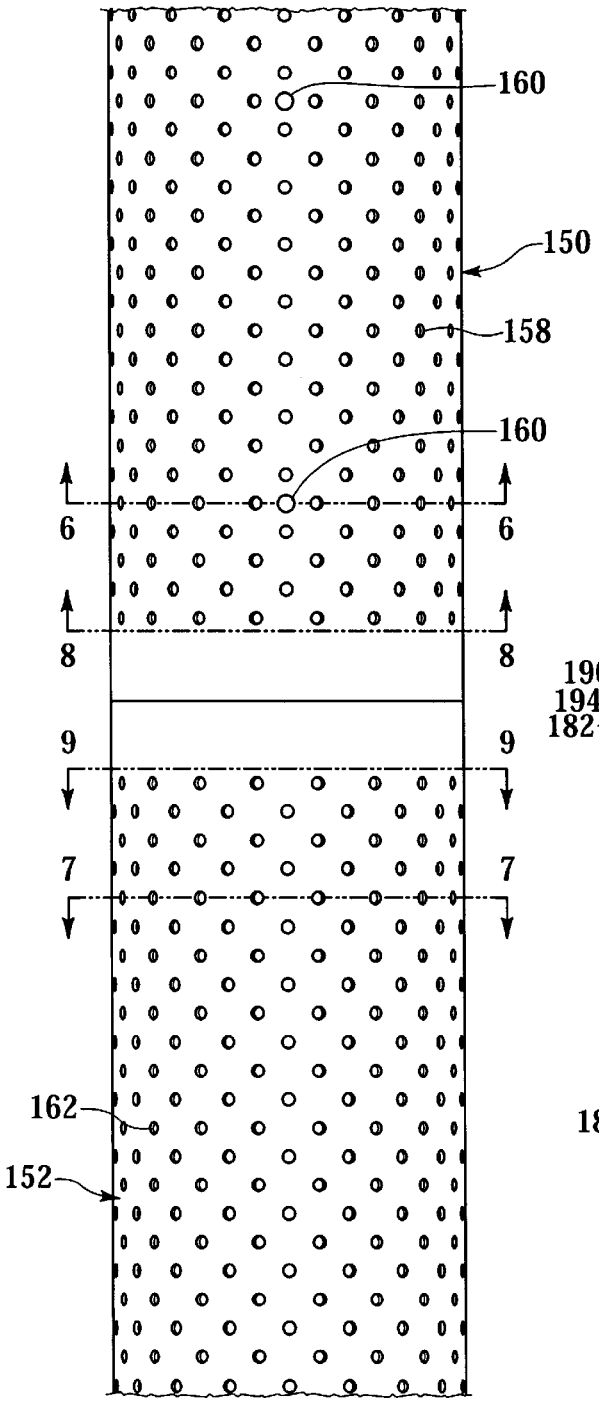
FIG. 4 is a side view of portions of two sections of an apparatus for gravel packing an interval of a wellbore of the present invention that are coupled together.
Figure 5:
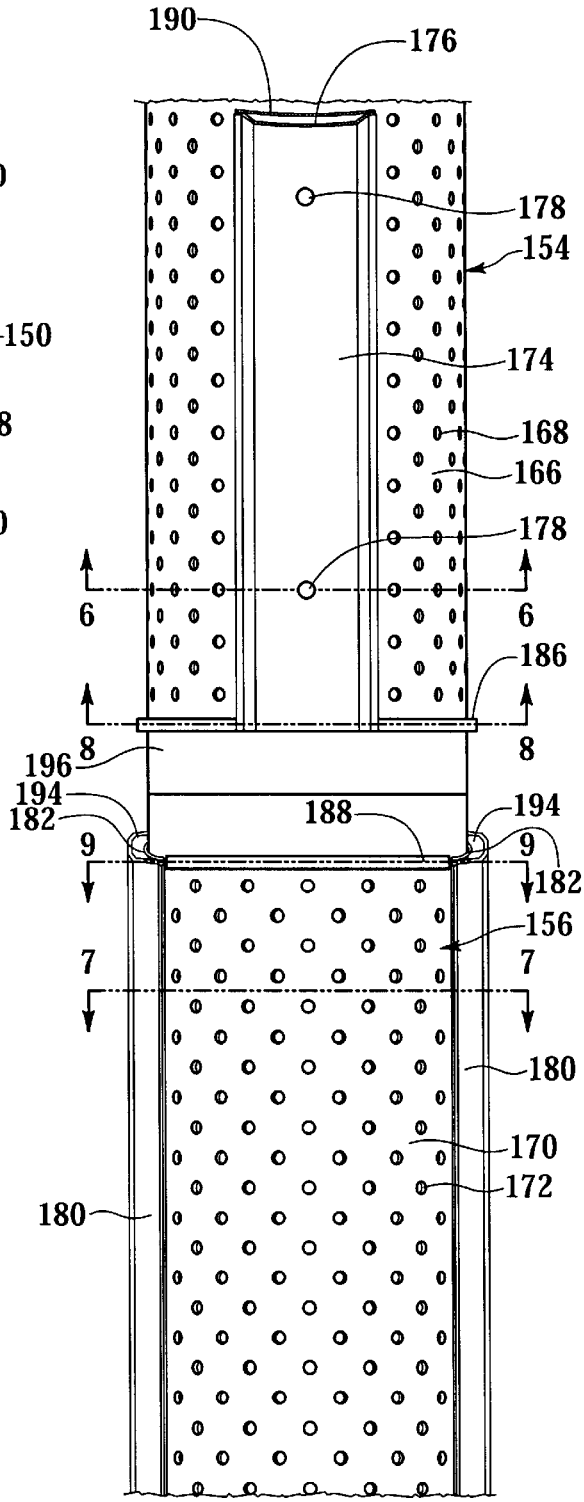
FIG. 5 is a side view of portions of two sections of a sand control screen for an apparatus for gravel packing an interval of a wellbore of the present invention that are coupled together.

Referring now to FIGS. 4 and 5, therein are depicted portions of two joints of outer tubulars designated 150 and 152 and corresponding portions of two joints of sand control screens designated 154 and 156, respectively. Outer tubular 150 has a plurality of openings 158 and several outlets 160. Likewise, outer tubular 152 has a plurality of openings 162 and several outlets 164, which are not visible in FIG. 4.

As should become apparent to those skilled in the art, even though FIG. 4 depicts outer tubular 150 and outer tubular 152 at a ninety-degree circumferential phase shift relative to one another, any degree of circumferential phase shift is acceptable using the present invention as the relative circumferential positions of adjoining joints of the apparatus for gravel packing an interval of a wellbore of the present invention does not affect the operation of the present invention. As such, the mating of adjoining joints of the apparatus for gravel packing an interval of a wellbore of the present invention is substantially similar to mating typical joints of pipe to form a pipe string requiring no special coupling tools or techniques.

Figure 6:
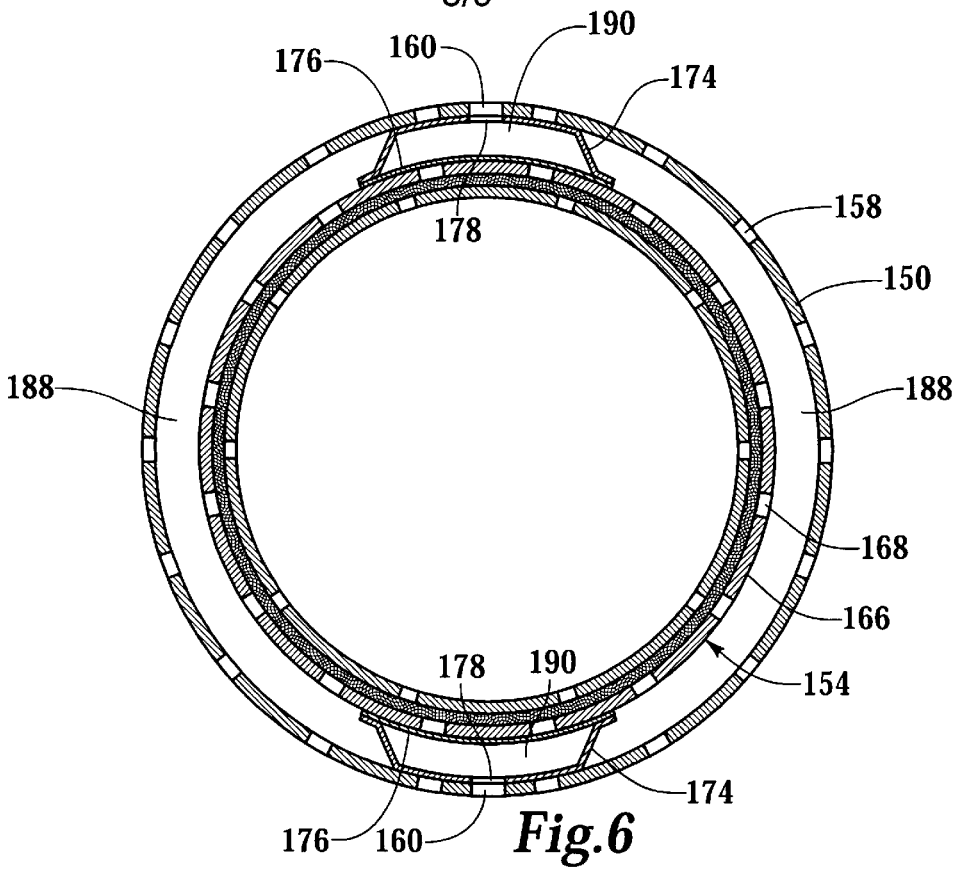
FIG. 6 is a cross sectional view of an apparatus for gravel packing an interval of a wellbore of the present invention taken along line 6—6 of FIGS. 4 and 5.
Figure 7:
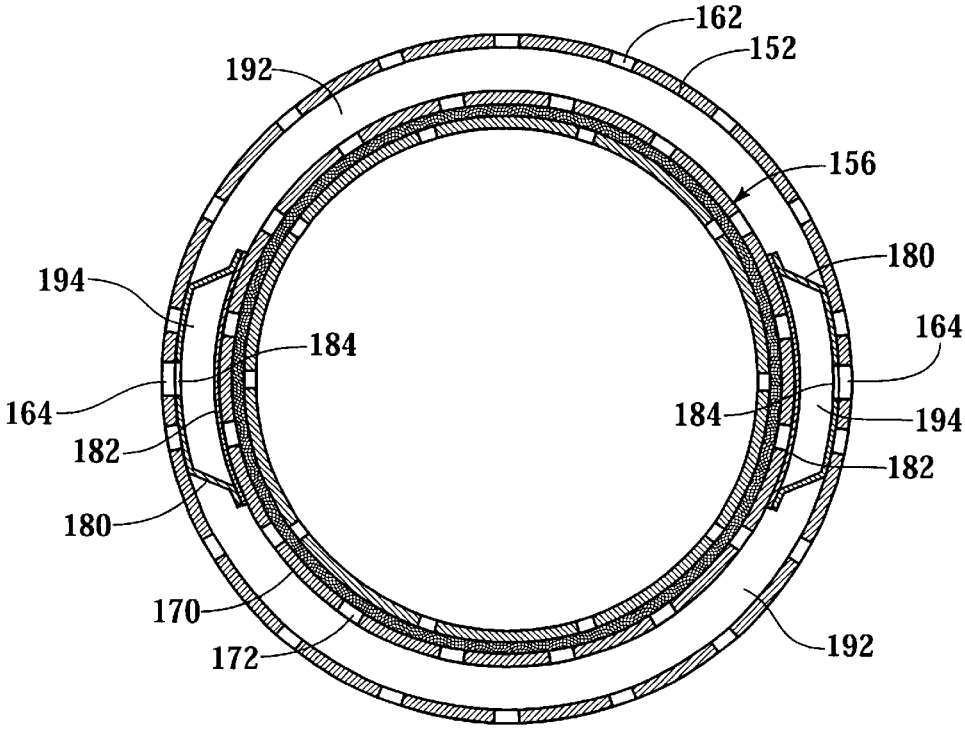
FIG. 7 is a cross sectional view of an apparatus for gravel packing an interval of a wellbore of the present invention taken along line 7—7 of FIGS. 4 and 5.

Sand control screen 154 includes outer wrapper 166 that has a plurality of openings 168. Likewise, sand control screen 156 includes outer wrapper 170 that has a plurality of openings 172. Sand control screen 154 has a pair of channels 174 and a pair of sheet members 176 attached thereto, only one of each being visible in FIG. 5. Channels 174 include outlets 178. Likewise, sand control screen 156 has a pair of channels 180 and a pair of sheet members 182 attached thereto. Channels 180 includes a plurality of outlets 184 which are not visible in FIG. 5. In the illustrated embodiment, sand control screens 154, 156 would be positioned within outer tubulars 150, 152 such that outlets 178 are axially and circumferentially aligned with outlets 160 of outer tubular 150, as best seen in FIG. 6 and such that outlets 184 are axially and circumferentially aligned with outlets 164 of outer tubular 152, as best seen in FIG. 7.

Figure 8:
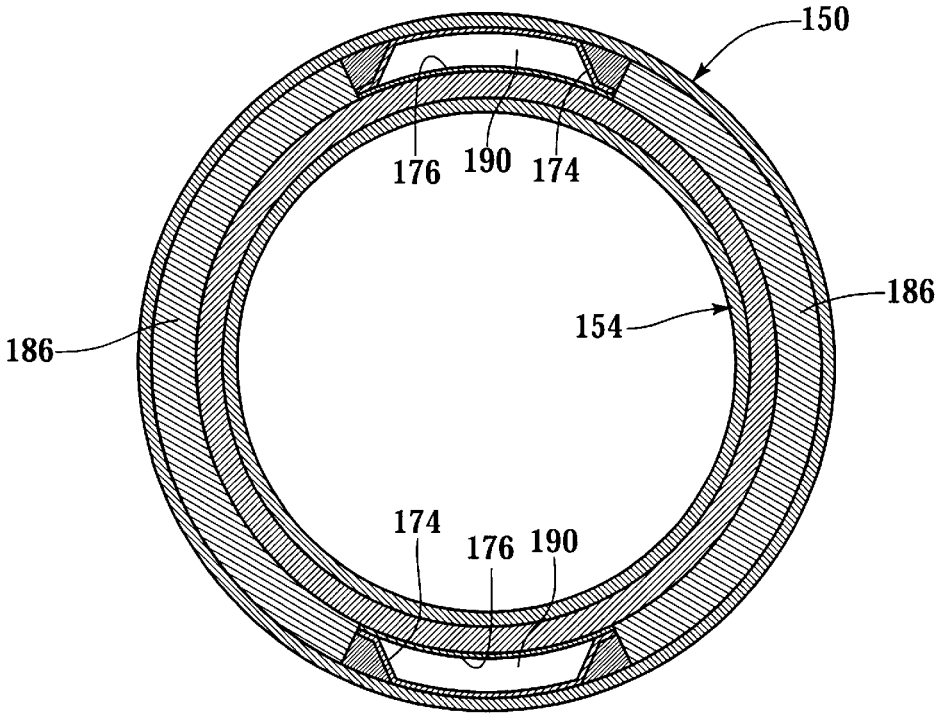
FIG. 8 is a cross sectional view of an apparatus for gravel packing an interval of a wellbore of the present invention taken along line 8—8 of FIGS. 4 and 5.
Figure 9:
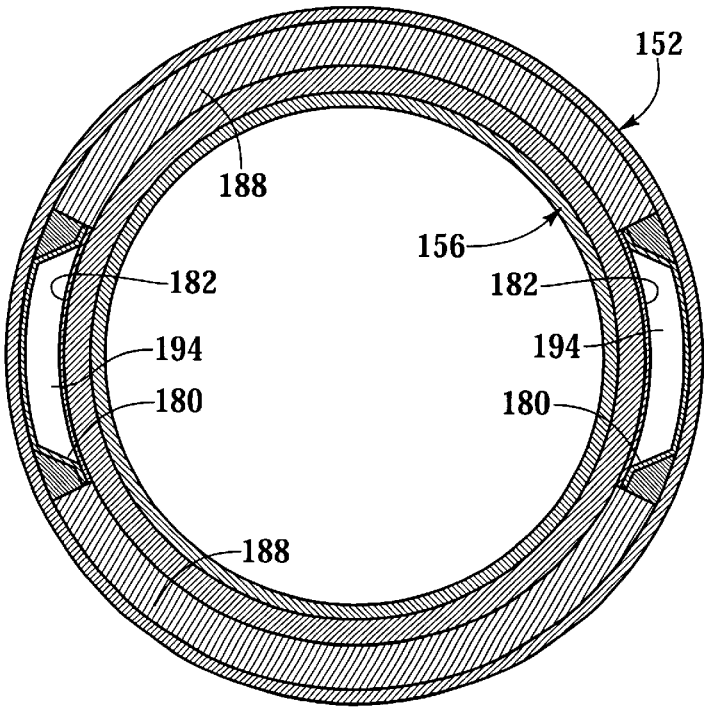
FIG. 9 is a cross sectional view of an apparatus for gravel packing an interval of a wellbore of the present invention taken along line 9—9 of FIGS. 4 and 5.

Each joint of the apparatus of the present invention includes a pair of axially spaced apart substantially circumferential isolation members. For example, isolation members 186 are shown on sand control screen 154 in FIGS. 5 and 8. Likewise, isolation members 188 are shown on sand control screen 156 in FIGS. 5 and 9.

Channels 174 define the circumferential boundaries of production pathways 188 and, together with sheet members 176, channels 174 define slurry passageways 190. Isolation members 186 help provide fluid isolation between production pathways 188 and slurry passageways 190. Channels 180 define the circumferential boundaries of production pathways 192 and, together with sheet members 182, channels 180 define slurry passageways 194. Isolation members 188 help provide fluid isolation between production pathways 192 and slurry passageways 194.

Importantly, however, slurry passageways 190 and slurry passageways 194 are all in fluid communication with one another such that a fluid slurry may travel in and between these passageways from one joint of the apparatus for gravel packing an interval of a wellbore of the present invention to the next. Specifically, as best seen in FIGS. 4 and 5, an annular region 196 exists between outer tubulars 150, 152 and sand control screens 154, 156 that allows the fluid slurry to travel downwardly from slurry passageways 190 through annular region 196 into slurry passageways 194. As such, regardless of the circumferential orientation of sand control screen 154 relative to sand control screen 156, the fluid slurry will travel down through each joint of the apparatus for gravel packing an interval of a wellbore of the present invention.

It should be apparent to those skilled in the art that the use of directional terms such as above, below, upper, lower, upward, downward and the like are used in relation to the illustrative embodiments as they are depicted in the figures, the upward direction being toward the top of the corresponding figure and the downward direction being toward the bottom of the corresponding figure. It should be noted, however, that the apparatus for gravel packing an interval of a wellbore is not limited to such orientation as it is equally-well suited for use in inclined and horizontal orientations.

As should be apparent to those skilled in the art, the apparatus for gravel packing an interval of a wellbore of the present invention may have a variety of configurations including configurations having other numbers of slurry passageways such as one, three, four or more slurry passageways, such configurations being considered within the scope of the present invention.

Figure 10:
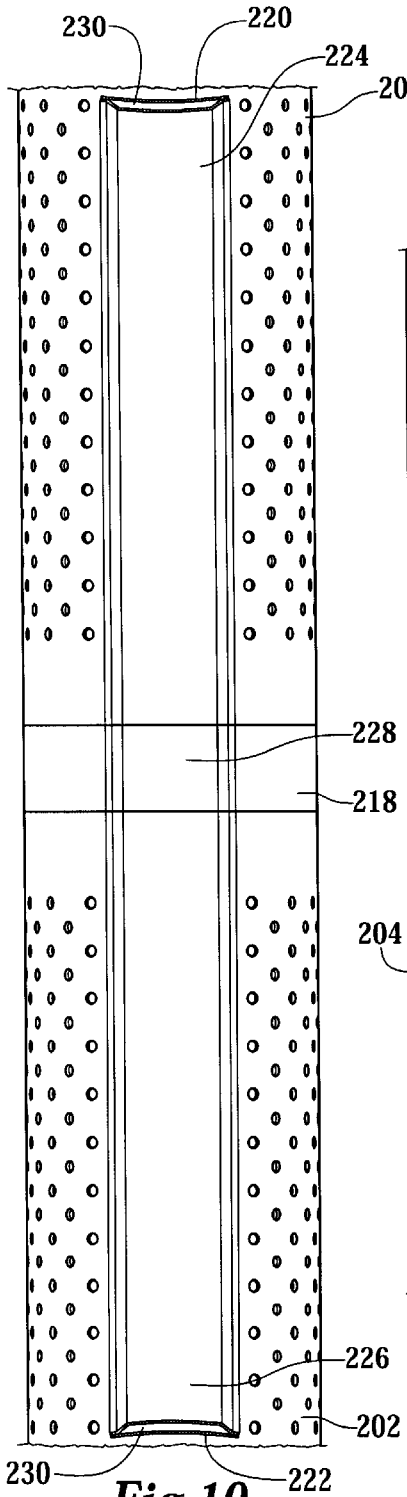
FIG. 10 is a side view of two channels connected together in an area between adjacent screen sections of an apparatus for gravel packing an interval of a wellbore of the present invention.
Figure 11:
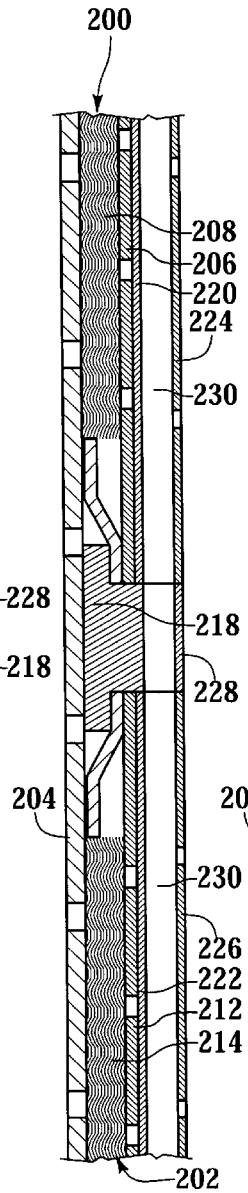
FIG. 11 is a cross sectional view of a spacer member for positioning between adjacent screen sections of an apparatus for gravel packing an interval of a wellbore of the present invention.

Referring next to FIGS. 10 and 11, therein are depicted a portion of a joint of the gravel packing apparatus of the present invention with the outer tubular removed wherein two screen sections are attached to the single joint of base pipe. Screen sections 200 and 202 are each attached to a single joint of base pipe 204. In the illustrated embodiment, screen section 200 includes a screen wrapper 206 and a filter medium 208. Likewise, screen section 202 includes a screen wrapper 212 and a filter medium 214.

As screen sections 200, 202 are commonly shorter than base pipe 204, two or more screen sections are preferably attached to each base pipe joint. This may be achieved by sliding screen sections 200, 202 onto base pipe 204 with a spacer member 218 positioned therebetween. In the illustrated embodiment, spacer member 218 is an annular ring having a two tier radial surface configuration that provides support to the respective ends of screen members 200, 202 which are secured to spacer member 218 by welding or other suitable technique. The other ends of screen sections 200, 202 are attached to base pipe 204 in a similar manner if additional screen sections are adjacent to the other ends of screen sections 200, 202. Alternatively, if screen sections 200, 202 are the last screen sections at the ends of base pipe 204, a simple ring or an isolation member, such as isolation member 188 of FIG. 9, may be used to attach the other ends of screen sections 200, 202 to base pipe 204.

Either before or after screen sections 200, 202 have been attached to base pipe 204, respective sheet members 220, 222 and channels sections 224, 226 are attached to screen sections 200, 202 by welding or other suitable technique. As a gap exists between channels sections 224, 226 in this configuration, a channel segment 228 is attached to the adjacent exposed ends of channels sections 224, 226 such that a continuous slurry passageway 230 is formed that extends substantially the entire length of the joint of the gravel packing apparatus of the present invention.

Figure 12:
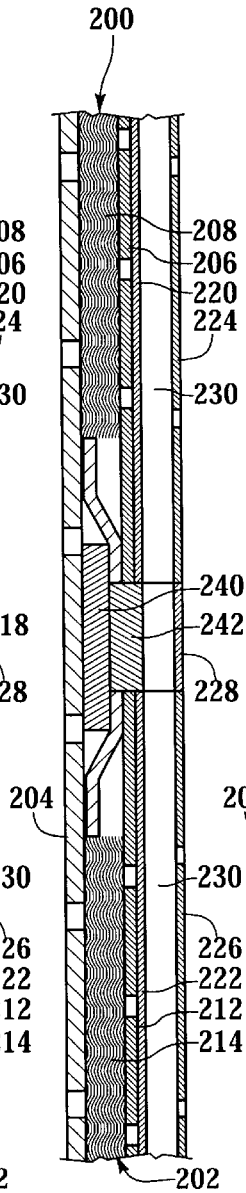
FIG. 12 is a cross sectional view of a spacer member for positioning between adjacent screen sections of an apparatus for gravel packing an interval of a wellbore of the present invention.

Instead of using an annular ring having a two tier radial surface configuration as the spacer member, a spacer member 240 that comprises an annular ring having a single radial surface configuration could alternatively be used, as best seen in FIG. 12. In this embodiment, a pad 242 having approximately the same circumferential width as the channel may be used. Pad 242 is attached to spacer member 240 by welding or other suitable technique. The remaining assembly of the joint of the gravel packing apparatus of the present invention is substantially the same as that described with reference to FIGS. 10 and 11.

Figure 13:
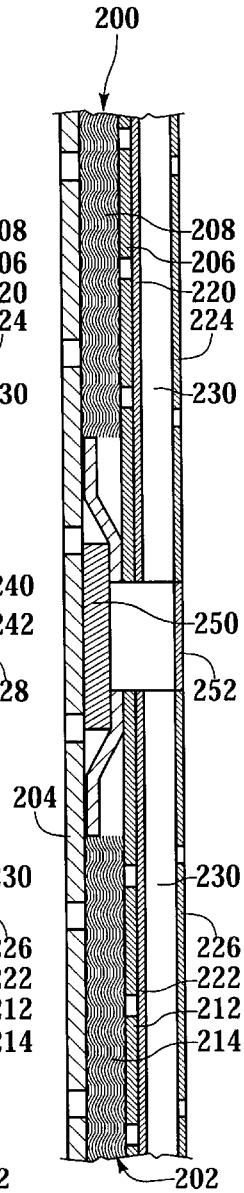
FIG. 13 is a cross sectional view of a spacer member for positioning between adjacent screen sections of an apparatus for gravel packing an interval of a wellbore of the present invention.

Referring next to FIG. 13, therein is depicted another embodiment of spacer member that is designated 250. In this embodiment, spacer member 250 is an annular ring having a single radial surface configuration. The remaining assembly of the joint of the gravel packing apparatus of the present invention is substantially the same as that described with reference to FIGS. 10 and 11 except that a channel segment 252 is attached to spacer member 250 without the aid of a raised center section or a pad by welding or other suitable technique to complete slurry passageway 230.

Figure 14:
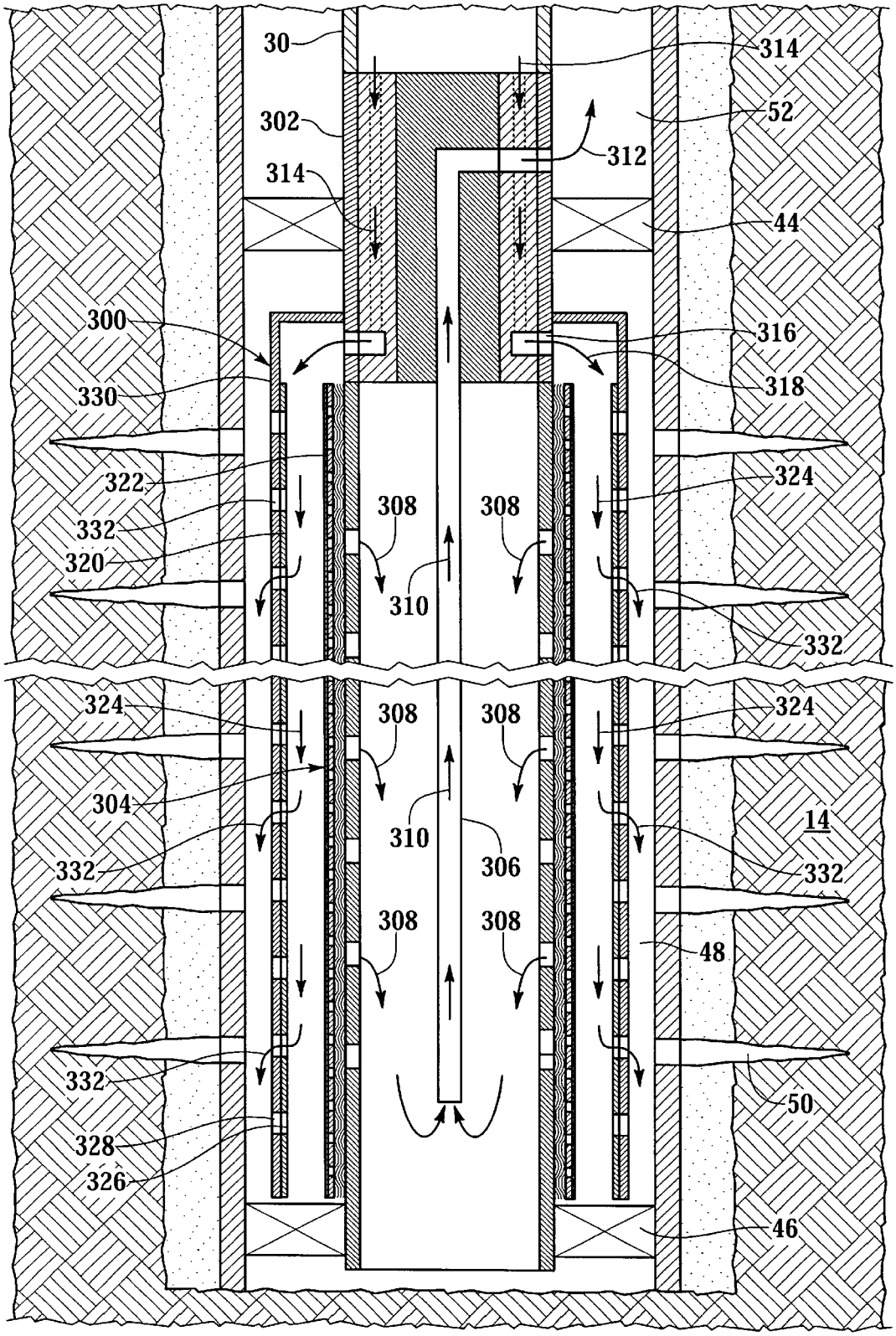
FIG. 14 is a half sectional view depicting the operation of an apparatus for gravel packing an interval of a wellbore of the present invention.

Referring now to FIG. 14, a typical completion process using an apparatus 300 for gravel packing an interval of a wellbore of the present invention will be described. First, interval 48 adjacent to formation 14 is isolated. Packer 44 seals the upper end of annular interval 48 and packer 46 seals the lower end of annular interval 48. Cross-over assembly 302 is located adjacent to screen assembly 304, traversing packer 44 with portions of cross-over assembly 302 on either side of packer 44. When the gravel packing operation commences, the objective is to uniformly and completely fill interval 48 with gravel. To help achieve this result, wash pipe 306 is disposed within screen assembly 304. Wash pipe 306 extends into cross-over assembly 302 such that return fluid passing through screen assembly 304, indicated by arrows 308, may travel through wash pipe 306, as indicated by arrow 310, and into annulus 52, as indicted by arrow 312, for return to the surface.

The fluid slurry containing gravel is pumped down work string 30 into cross-over assembly 302 along the path indicated by arrows 314. The fluid slurry containing gravel exits cross-over assembly 302 through cross-over ports 316 and is discharged into apparatus 300 as indicated by arrows 318. In the illustrated embodiment, the fluid slurry containing gravel then travels between channels 320 and sheet member 322 as indicated by arrows 324. At this point, portions of the fluid slurry containing gravel exit apparatus 300 through outlets 326 of channels 320 and outlets 328 of outer tubular 330, as indicated by arrows 332. As the fluid slurry containing gravel enters annular interval 48, the gravel drops out of the slurry and builds up from formation 14, filling perforations 50 and annular interval 48 around apparatus 300 forming the gravel pack. Some of the carrier fluid in the slurry may leak off through perforations 50 into formation 14 while the remainder of the carrier fluid passes through screen assembly 304, as indicated by arrows 308, that is sized to prevent gravel from flowing therethrough. The fluid flowing back through screen assembly 304, as explained above, follows the paths indicated by arrows 310, 312 back to the surface.

In operation, the apparatus for gravel packing an interval of a wellbore of the present invention is used to distribute the fluid slurry to various locations within the interval to be gravel packed by injecting the fluid slurry into the slurry passageways created by the channels and the sheet members of one or more joints of the apparatus. The fluid slurry exits through the various outlets along the slurry passageway and enters the annulus between the apparatus and the wellbore which may be cased or uncased. Once in this annulus, a portion of the gravel in the fluid slurry is deposited around the apparatus in the annulus such that the gravel migrates both circumferentially and axially from the outlets. This process progresses along the entire length of the apparatus such that the annular area becomes completely packed with the gravel. In addition, a portion of the fluid slurry enters the opening of the outer tubular which provides for the deposit of a portion of the gravel from the fluid slurry in the production pathways between the outer tubulars and the sand control screens. Again, this process progresses along the entire length of the apparatus such that each production pathway becomes completely packed with the gravel. Once both the annulus and the production pathways are completely packed with gravel, the gravel pack operation may cease.

Figure 15:
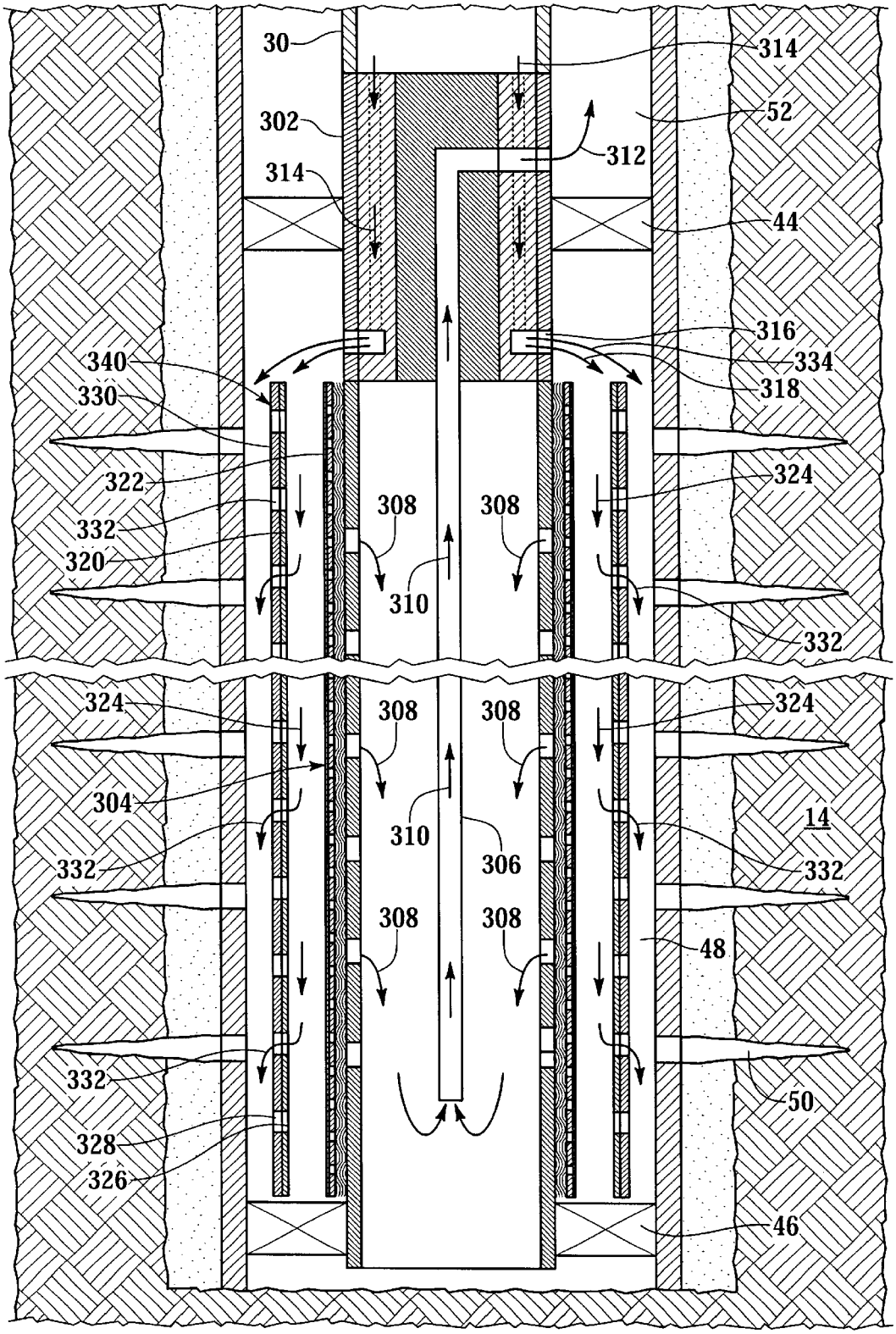
FIG. 15 is a half sectional view depicting the operation of another embodiment of an apparatus for gravel packing an interval of a wellbore of the present invention.

In some embodiments of the present invention, the fluid slurry may not initially be injected into the slurry passageways. Instead, the fluid slurry is injected directly into the annulus between the apparatus 340 and the wellbore, as best seen in FIG. 15. In the illustrated embodiment, the primary path for the fluid slurry containing gravel as it is discharged from exit ports 316, is directly into annular interval 48 as indicated by arrows 334. This is the primary path as the fluid slurry seeks the path of least resistance. Under ideal conditions, the fluid slurry travels throughout the entire interval 48 until interval 48 is completely packed with gravel. In addition, the fluid slurry enters the production pathways of apparatus 340 such that this area is also completely packed with gravel.

It has been found, however, that sand bridges commonly form during the gravel packing of an interval when the fluid slurry is pumped directly into annular interval 48. These sand bridges are bypassed using the apparatus for gravel packing an interval of a wellbore of the present invention by first allowing the fluid slurry to pass through the outer tubular into the production pathways of apparatus 340, bypassing the sand bridge and then returning to annular interval 48 through the outer tubular to complete the gravel packing process. These pathways are considered the secondary path for the fluid slurry. If a sand bridge forms in the secondary paths prior to completing the gravel packing operation, then the fluid slurry enters channels 320 as indicated by arrows 318 and as described above with reference to FIG. 14. In this embodiment, channels 320 are considered the tertiary path for the fluid slurry.

In either embodiment, once the gravel pack is completed and the well is brought on line, formation fluids that are produced into the gravel packed interval must travel through the gravel pack in the annulus, then enter the production pathways through the openings in the outer tubular where the formation fluids pass through the gravel pack between the outer tubular and the screen assembly. As such, the apparatus for gravel packing an interval of a wellbore of the present invention allows for a complete gravel pack of an interval so that particulate materials in the formation fluid are filtered out.

While this invention has been described with reference to illustrative embodiments, this description is not intended to be construed in a limiting sense. Various modifications and combinations of the illustrative embodiments as well as other embodiments of the invention, will be apparent to persons skilled in the art upon reference to the description. It is, therefore, intended that the appended claims encompass any such modifications or embodiments.

What is claimed is:

1. An apparatus for gravel packing an interval of a wellbore, the apparatus comprising:

an outer tubular having a plurality of production openings that allow the flow of production fluids therethrough and a plurality of outlets the allow the flow of a fluid slurry containing gravel therethrough;

a sand control screen disposed within the outer tubular to form an annulus therebetween, the sand control screen including a perforated outer tubular wrapper that prevents the flow of particulate material of a predetermined size therethrough but allows the flow of production fluids therethrough;

a sheet member positioned on the sand control screen such that the sheet member extends at least substantially along the length of the sand control screen and partially around the circumference of the sand control screen; and a channel having a plurality of outlets disposed within the annulus and substantially circumferentially aligned with the sheet member forming a slurry passageway therewith, the outlets of the channel substantially aligned with the outlets of the outer tubular.

2. The apparatus as recited in claim 1 wherein the channel further comprises a web and a pair of oppositely disposed sides.

3. The apparatus as recited in claim 1 wherein the channel is sealably attached to the sand control screen.

4. The apparatus as recited in claim 1 wherein the sand control screen further comprises a filter medium comprising a plurality of sintered layers of wire mesh positioned between a perforated base pipe and the interior of the perforated tubular wrapper.

5. The apparatus as recited in claim 1 further comprising a production pathway formed within a portion of the annulus not circumferentially aligned the channel.

6. An apparatus for gravel packing an interval of a wellbore, the apparatus comprising an outer tubular forming a first annulus with the wellbore and a sand control screen disposed within the outer tubular forming a second annulus therebetween, the second annulus including an axially extending production pathway and an axially extending slurry passageway defined between a sheet member positioned on the sand control screen and a channel, the slurry passageway being in fluid isolation from the production pathway such that when a fluid slurry containing gravel is injected through the slurry passageway, the fluid slurry exits the apparatus through outlets of the channel and outlets of the outer tubular leaving a first portion of the gravel in the first annulus then enters openings in the outer tubular leaving a second portion of the gravel in the production pathway and such that when formation fluids are produced, the formation fluids enter the production pathway through the openings in the outer tubular and exit the production pathway through the sand control screen passing through the first and second portions of the gravel.

7. The apparatus as recited in claim 6 wherein the channel further comprises a web and a pair of oppositely disposed sides.

8. The apparatus as recited in claim 6 wherein the channel is sealably attached to the sand control screen.

9. The apparatus as recited in claim 6 wherein the sand control screen further comprises an outer wrapper.

10. The apparatus as recited in claim 9 wherein the outer wrapper further comprises a wire wrap.

11. The apparatus as recited in claim 9 wherein the outer wrapper further comprises a perforated tubular wrapper.

12. The apparatus as recited in claim 11 wherein the sand control screen further comprises a filter medium comprising a plurality of sintered layers of wire mesh positioned between a perforated base pipe and the interior of the perforated tubular wrapper.

13. An apparatus for gravel packing an interval of a wellbore, the apparatus comprising:

an outer tubular having a plurality of production openings that allow the flow of production fluids therethrough and a plurality of outlets the allow the flow of a fluid slurry containing gravel therethrough;

a sand control screen disposed within the outer tubular to form an annulus therebetween, the sand control screen preventing the flow of particulate material of a predetermined size therethrough but allowing the flow of production fluids therethrough, the sand control screen including a perforated base pipe and an outer perforated tubular wrapper having a plurality of sintered layers of wire mesh positioned therebetween;

a sheet member positioned on the sand control screen such that the sheet member extends at least substantially along the length of the sand control screen and partially around the circumference of the sand control screen; and a channel having a plurality of outlets disposed within the annulus and substantially circumferentially aligned with the sheet member forming a slurry passageway therewith, the outlets of the channel substantially aligned with the outlets of the outer tubular.

14. The apparatus as recited in claim 13 wherein the channel further comprises a web and a pair of oppositely disposed sides.

15. The apparatus as recited in claim 13 wherein the channel is sealably attached to the sand control screen.

16. An apparatus for gravel packing an interval of a wellbore, the apparatus comprising:

a sand control screen that prevents the flow of particulate material of a predetermined size therethrough but allowing the flow of production fluids therethrough; and an outer tubular disposed around the sand control forming a first annulus therewith and a second annulus with the wellbore, the first annulus including a production pathway and a slurry passageway, the slurry passageway defined between a sheet member positioned on the sand control screen and a channel, wherein when the apparatus is in an operable position, the second annulus serves as a primary path for delivery of a fluid slurry, the production pathway serves as a secondary path for delivery of the fluid slurry when the primary path becomes blocked and the slurry passageway serves as a tertiary path for delivery of the fluid slurry when the primary and secondary paths become blocked.

17. A method for gravel packing an interval of a wellbore, the method comprising the steps of:

traversing a formation with the wellbore;

locating a gravel packing apparatus within the wellbore proximate the formation forming a first annulus with the wellbore, the gravel packing apparatus including an outer tubular positioned around a sand control screen forming a second annulus therebetween, the sand control screen including a perforated tubular outer wrapper, the second annulus including an axially extending production pathway and an axially extending slurry passageway defined between a sheet member positioned on the sand control screen and a channel, the slurry passageway being in fluid isolation from the production pathway;

injecting a fluid slurry containing gravel through the slurry passageway such that the fluid slurry exits the slurry passageway through outlets in the channel, which are substantially aligned with outlets in the outer tubular, leaving at least a portion of the gravel in the first annulus; and terminating the injecting.

18. The method as recited in claim 17 further comprising the step of sealably attaching the channel to the sand control screen.

19. The method as recited in claim 17 wherein the step of including an outer wrapper on the sand control screen further comprises including a filter medium comprising a plurality of sintered layers of wire mesh positioned between a perforated base pipe and the interior of the perforated tubular wrapper.

20. The method as recited in claim 17 further comprising the step of defining a production pathway within a portion of the second annulus not circumferentially aligned the channel.

21. A method for gravel packing an interval of a wellbore, the method comprising the steps of:

traversing a formation with the wellbore;

locating a gravel packing apparatus within the wellbore proximate the formation forming a first annulus with the wellbore, the gravel packing apparatus including an outer tubular positioned around a sand control screen forming a second annulus therebetween, the second annulus including an axially extending production pathway and an axially extending slurry passageway defined between a sheet member positioned on the sand control screen and a channel, the slurry passageway being in fluid isolation from the production pathway;

injecting a fluid slurry containing gravel through the slurry passageway such that the fluid slurry exits the slurry passageway through outlets in the channel, which are substantially aligned with outlets in the outer tubular, into the first annulus;

depositing a first portion of the gravel in the first annulus;

depositing a second portion of the gravel in the production pathway by returning a portion of the fluid slurry through openings in the outer tubular; and terminating the injecting.

22. The method as recited in claim 21 further comprising the step of sealably attaching the channel to the sand control screen.

23. The method as recited in claim 21 wherein the step of locating a gravel packing apparatus within the wellbore further comprises including an outer wrapper on the sand control screen.

24. The method as recited in claim 23 wherein the step of including an outer wrapper on the sand control screen further comprises including an outer wrapper comprises a wire wrap.

25. The method as recited in claim 23 wherein the step of including an outer wrapper on the sand control screen further comprises including an outer wrapper comprises a perforated tubular wrapper.

26. The method as recited in claim 25 wherein the step of including an outer wrapper on the sand control screen further comprises including a filter medium comprising a plurality of sintered layers of wire mesh positioned between a perforated base pipe and the interior of the perforated tubular wrapper.

27. The method as recited in claim 21 further comprising the step of defining a production pathway within a portion of the second annulus not circumferentially aligned the channel.

28. A method for gravel packing an interval of a wellbore, the method comprising the steps of:

traversing a formation with the wellbore;

locating a gravel packing apparatus within the wellbore proximate the formation forming a first annulus with the wellbore, the gravel packing apparatus including an outer tubular positioned around a sand control screen forming a second annulus therebetween, the second annulus including an axially extending production pathway and an axially extending slurry passageway defined between a sheet member positioned on the sand control screen and a channel, the slurry passageway being in fluid isolation from the production pathway;

injecting a fluid slurry containing gravel into a primary path defined by the first annulus;

diverting the fluid slurry containing gravel into a secondary path defined by the production pathway if the primary path becomes blocked;

diverting the fluid slurry containing gravel into a tertiary path defined by the slurry passageway if the primary and secondary paths become blocked; and terminating the injecting.

* * * * *

UNITED STATES PATENT AND TRADEMARK OFFICE

CERTIFICATE OF CORRECTION

PATENT NO. : 6,789,624 B2
DATED : September 14, 2004
INVENTOR(S) : Ronald W. McGregory et al.

It is certified that error appears in the above-identified patent and that said Letters Patent is hereby corrected as shown below:

Title page,
Item [75], Inventors, "Robert Crow" should read -- Robert W. Crow --.

Signed and Sealed this

Twenty-first Day of February, 2006

JON W. DUDAS
*Director of the United States Patent and Trademark Office*